United States Patent [19]

Post

[11] Patent Number: 4,899,084

[45] Date of Patent: Feb. 6, 1990

[54] PARTICLE ACCELERATOR EMPLOYING TRANSIENT SPACE CHARGE POTENTIALS

[75] Inventor: Richard F. Post, Walnut Creek, Calif.

[73] Assignee: The United States of America as represented by the United States Department of Energy, Washington, D.C.

[21] Appl. No.: 160,384

[22] Filed: Feb. 25, 1988

[51] Int. Cl.[4] ..... H05H 5/00; H01J 7/24

[52] U.S. Cl. ..... 315/111.81; 315/111.41; 315/111.61; 313/359.1; 328/233; 376/127

[58] Field of Search ..... 315/111.21, 111.41, 315/111.61, 111.51, 111.81, 111.91, 5.41, 5.42, 5.43; 313/362.1, 359.1, 360.1, 231.31, 161, 361.1; 328/233, 244, 256; 250/282, 423 R, 427; 376/125, 127

[56] References Cited

U.S. PATENT DOCUMENTS

| | | | |
|---|---|---|---|
| 3,038,099 | 6/1962 | Baker et al. | 313/161 |
| 3,052,614 | 9/1962 | Herold | 313/161 |
| 3,104,345 | 9/1963 | Wilcox et al. | 313/161 |
| 3,166,477 | 1/1965 | Leboutet | 313/161 |
| 3,258,645 | 6/1966 | Bankston, Jr. | 315/111.61 |
| 3,321,664 | 5/1967 | Phillips et al. | 315/111.61 |
| 3,329,864 | 7/1967 | Michel et al. | 315/111.61 |
| 3,388,291 | 6/1968 | Cann | 315/111.61 |
| 3,624,240 | 11/1971 | Damm et al. | 313/161 X |
| 4,292,568 | 9/1981 | Wells et al. | 315/111.41 X |
| 4,293,794 | 10/1981 | Kapetanakos | 315/111.41 X |
| 4,393,333 | 7/1983 | Sakudo et al. | 315/111.81 |
| 4,409,520 | 10/1983 | Koike et al. | 315/39 |
| 4,598,231 | 7/1986 | Matsudo et al. | 315/111.81 |

FOREIGN PATENT DOCUMENTS

| | | | |
|---|---|---|---|
| 0374041 | 10/1979 | U.S.S.R. | 315/111.41 |

OTHER PUBLICATIONS

Post, "Generator and Control . . . a Mirror-Confined Plasma", Phy. Rev. Letters, Mar. 2, 1987, pp. 878–881.

*Primary Examiner*—Eugene R. LaRoche
*Assistant Examiner*—Seung Ham
*Attorney, Agent, or Firm*—Michael B. K. Lee; Clifton E. Clouse, Jr.; William R. Moser

[57] ABSTRACT

The invention provides an accelerator for ions and charged particles. The plasma is generated and confined in a magnetic mirror field. The electrons of the plasma are heated to high temperatures. A series of local coils are placed along the axis of the magnetic mirror field. As an ion or particle beam is directed along the axis in sequence the coils are rapidly pulsed creating a space charge to accelerate and focus the beam of ions or charged particles.

16 Claims, 3 Drawing Sheets

PARTICLE ACCELERATOR EMPLOYING TRANSIENT SPACE CHARGE POTENTIALS

BACKGROUND OF THE INVENTION

The U.S. Government has rights in this invention pursuant to Contract No. W-7405-ENG-48 between the U. S. Department of Energy and the University of California, for the operation of Lawrence Livermore National Laboratory.

This invention relates to a particle accelerator which utilizes a space charge transiently created in a heated plasma.

In the field of particle accelerators, over the last few decades several different techniques have been used to accelerate and direct ions or charged particles. Different techniques are used to establish an electric field used to accelerate the nuclear particle. In many accelerators magnetic fields are used to guide the accelerated particles. Many of the particle accelerators in the field of the invention are described in THE STATE OF PARTICLE ACCELERATORS AND HIGH ENERGY PHYSICS, AIP Conference Proceedings No. 92, edited by R. A. Carrigan, F. R. Hudson, and M. Month, American Institute of Physics, 1982.

An example of the use of space charge to accelerate ions was the Pleade experiment. This experiment demonstrated the acceleration of a low energy ion beam using a positive space charge to accelerate the ions. In Pleade 400 watts of c.w. microwave power at approximately 2800 MHz was applied to a plasma near one end of a magnetic mirror type field. The steady state microwave power at one end of the magnetic type mirror field continuously expelled electrons from the local region creating a steady local positive space charge. The positive local space charge was used to accelerate positively charged particles or ions. Since the magnetic mirror fields and the rate of generation of new ions and electrons by the microwave power were both constant in Pleade, the energy to which ions could be accelerated in this type of system was strongly limited to values of at most a few kiloelectron volts. This limitation comes about because the plasma ions were continually being expelled from the region of positive potential by the very presence of the potential itself. Thus the Pleade type of particle accelerator is inherently limited to the acceleration of locally generated ions to modest kinetic energies. Furthermore, because this technique results in the generation of steady potentials it is not possible to use it in a multi-staged accelerator, since the net change in energy of any ion injected from *outside* the potential region is zero. (Injected ions are first decelerated, then accelerated back to their original energy, in passing through a region of steady potential.)

SUMMARY OF THE INVENTION

An object of the invention is to provide a simple and inexpensive apparatus to accelerate ions or charged particles.

Another object of the invention is to provide a temporally controlled positive space charge in such an accelerator.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

The invention comprises a plasma composed of high energy electrons and lower temperature ions held in a magnetic field created by magnetic mirrors. Local mirrors are sequentially pulsed to create local regions of space charge which sequentially accelerate an ion or charged particle beam.

BRIEF DESCRIPTION OF THE DRAWINGS

The accompanying drawings, which are incorporated and form a part of the specification, illustrate embodiments of the invention and, together with the description, serve to explain the principles of the invention.

DESCRIPTIONS OF THE PREFERRED EMBODIMENTS

Figure 1:
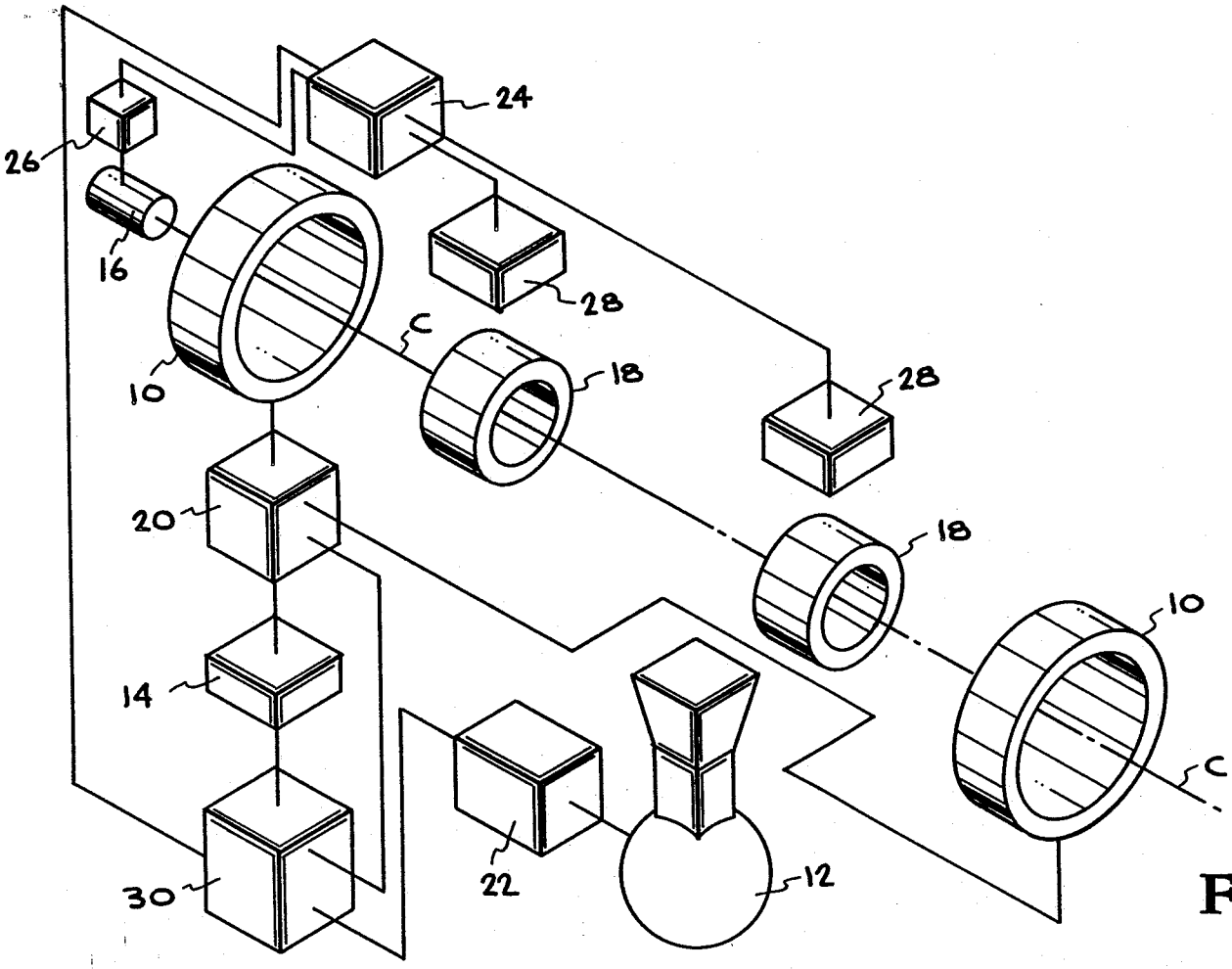
FIG. 1 is an illustration of one embodiment of the invention.

FIG. 1 is an illustration of one embodiment of the invention, which is discussed in "Generation and Control of High Transient Electrical Potentials within a Mirror-Confined Plasma," by Richard F. Post, PHYSICAL REVIEW LETTERS, Vol. 58, No. 9, pp. 878–881, Mar. 2, 1987 incorporated by reference. In this embodiment, magnetic mirrors 10 are used to create dc mirror cells in a magnetic mirror type magnetic field, which will be used to hold a hot electron plasma. Since this requires that the magnetic field created by the magnetic mirrors 10 be a continuous magnetic field the magnetic mirrors 10 are powered by a continuous power source 20. These magnetic mirrors 10 may have a mirror ratio on the order of two. A mirror ratio is defined as the ratio between the strongest point of the magnetic field along the magnetic mirror axis C—C and the weakest point of the magnetic field within the magnetic mirror and along its axis. Microwave source 12 is positioned to create and heat a plasma consisting of high energy electrons and lower energy ions held in the magnetic field. Since the microwave source 12 continuously provides energy to the plasma, the microwave source 12 is powered by a continuous power source 22. Additional heating could be accomplished by slow adiabatic magnetic compression of a pre-heated plasma using the magnetic mirrors 10 (or additional coils) in addition to or in place of the microwave source 12. Power source 14 adds a slowly increasing voltage to the dc component provided by power source 20 of the magnetic mirrors 10. The slowly increasing voltage slowly increases the magnetic field of the magnetic mirrors and the magnetic field between them, causing adiabatic compression. The plasma electrons would be heated to high temperatures (which in this application is defined as kiloelectron to megaelectron volt temperatures) and would typically be allowed to approach a collisional state such that its electron distribution function would attain a quasistatic loss-cone shape. The plasma density and electron temperature would be such as to cause only a minor perturbation of the confining fields.

Ion or particle beam source 16 introduces spacially bunched ions or charged particles on a path along the axis of the magnetic mirror. As the ions or charged particles pass the local coils 18, each local coil is rapidly pulsed up in current. The local coils 18 produce a local mirror, the height of which is comparable to, or larger than, that of the magnetic mirrors 10. As the local coil's field increases, hot electrons begin to be expelled from the region by the increasing field. On a sufficiently rapid time scale, however, the plasma ions would be essentially motionless, because of their heavy mass and low kinetic temperature. At this point the plasma quasineutrality constraint would step in; i.e., a positive potential would arise within the plasma of just such a magnitude as to preserve near equality between the electron and plasma ion density. The resulting positive space charge, which creates the positive potential, thereby accelerates the positively charged ions or charged particles in the injected beam. To successively accelerate a group of ions or charged particles, the local coils 18 are pulsed sequentially in time with the arrival of these particles. Since local coils 18 must be pulsed in sychronism with the ion or particle beam source 16, the power source or switch 26 for the ion or particle beam source 16 must be governed by a timer 24 which also controls the power sources or switches 28 for the local coils 18.

Timer or switch 30 controls timer 24 and power supplies 14, 20 and 22 to allow a cyclicly generated adiabatically compressed plasma.

As will be discussed below, the advantage of the invention is that not only can the local potential be very large (of order several megavolts) but also that its distribution in space and time can be accurately controlled by spatial and temporal variation of the applied magnetic field. Since the applied magnetic field can be easily tailored, the invention provides an effective means for the external control of space charge accelerating fields which can in turn control and focus the accelerated particle beams. This feature distinguishes the present invention from other accelerators that attempt to use space charge potentials for accelerators but do not have as effective a means for their control.

Figure 2:
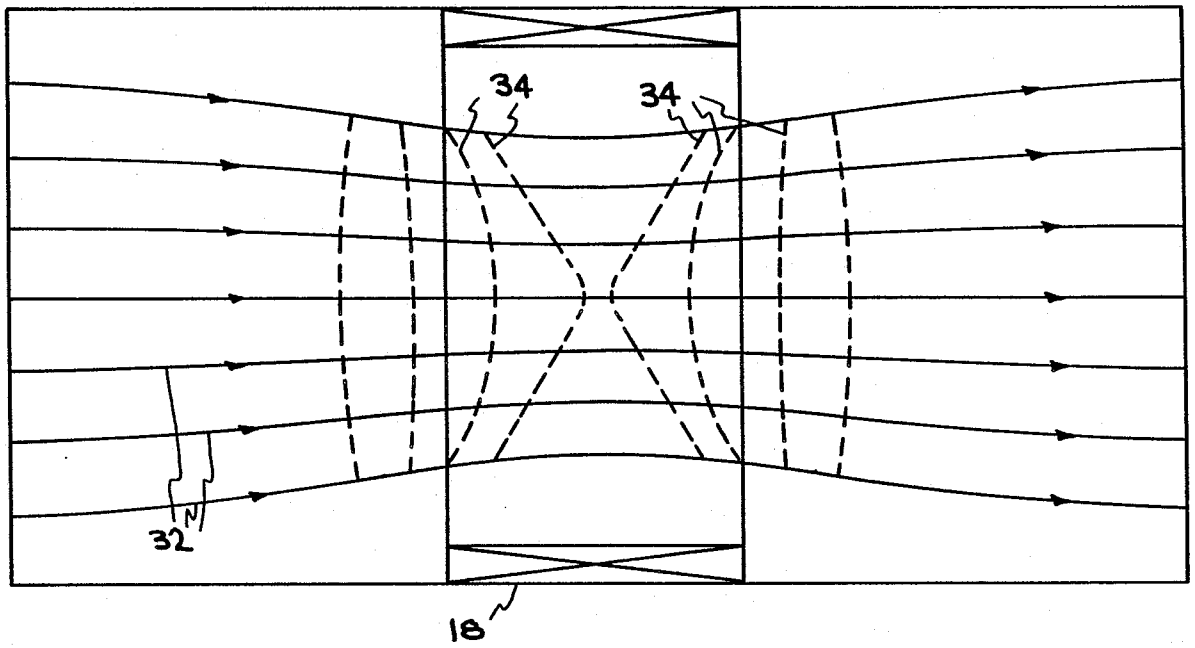
FIG. 2 is an illustration of the magnetic field lines near a local coil.

FIG. 2 illustrates the magnetic field in the region of a local coil 18. The magnetic field lines 32 are generated by the magnetic mirrors 10 and the local coils 18. In this embodiment, the magnetic mirrors 10 create a constant 5000 G field along the axis of the magnetic mirror field. The local coil 18 also generates a 5000 G field. Each local coil is 10 cm long. Near the region of the local coil the magnetic field lines 32 are compressed. As shown by theory in the article "Generation and Control of High Transient Electrical Potentials within a Mirror-Confined Plasma," by Richard F. Post, PHYSICAL REVIEW LETTERS, Vol. 58, No. 9, pgs 878–881, Mar. 2, 1987, which is incorporated by reference, electrical equipotential lines 34 are determined by and congruent with lines of constant magnetic intensity. The curvature of the electrical equipotential lines 34 can be such as to cause focusing of the ion beam. This effect can act to provide a focused and spatially controlled ion or charged particle beam. It is apparent that by modifying the shape of the local coil 18 and that of the magnetic mirrors 10, one could shape the electrical equipotentials so as to have a substantial degree of control over both the focusing and the bunching of the beam, but not necessarily subject to the intrinsic focusing-defocusing nature of conventional (vacuum) accelerating fields, since the accelerating fields are here of space-charge origin.

Magnetic-fusion research demonstrates that low-density hot-electron plasmas can be made highly stable against both MHD and high-frequency wave-particle instabilities. MHD instabilities are well controlled by high-order multipole (magnetic well) fields. Also the fact that a critical parameter for the onset of high frequency instabilities, namely, $w_{pe}^2/w_{ce}^2$ (where $w_{pe}$ is the frequency of the ions and $w_{ce}$ is the frequency of the electrons) can be made small (of the order 0.01 in the embodiment given), when coupled with the relativistically induced spread of electron-cyclotron frequencies, makes the appearance of significant levels of high-frequency instabilities highly improbable. A. Goede, G. J. Brakenhoff, H. J. Hopman, and P. Massman, in the Physical Review Letters, Volume 27, beginning at page 1044 (1971) and R. A. Dandl et al. in Plasma Physics and Controlled Fusion Research (IAEA, Vienna, 1969) Volume 2 beginning at page 435, describe in more detail how to prevent instabilities in low-density hot-electron plasmas.

Figure 3:
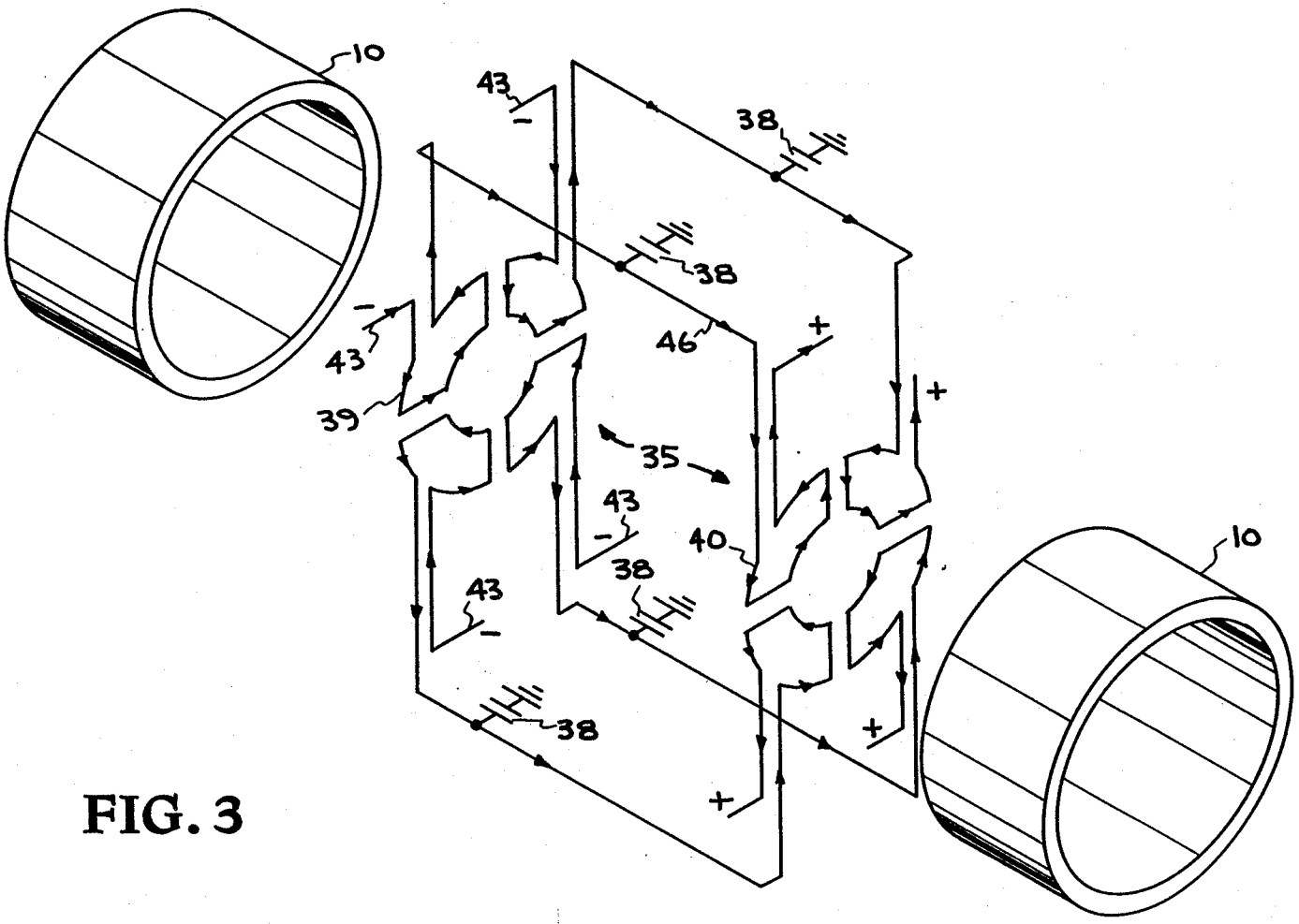
FIG. 3 is an illustration of another embodiment of the invention.

FIG. 3 is a schematic diagram of part of another embodiment of the invention. The embodiment shown in FIG. 3 is like the embodiment shown in FIG. 1. One difference in the embodiment illustrated in FIG. 3 is that in FIG. 3 each local coil 35 is made of a plurality of segments to create a series of segmented local coils 35. A segment of the first local coil 39 is electronically connected to one segment of the second local coil 40 by a transmission line 46. Segmenting the local coil decreases the inductance of the circuit and therefore decreases the voltage required to drive the coil current to high values in the short times demanded. Pulses running along each transmission line 43 will sequentially pulse the segments of the local coils 35. Capacitors 38 are added to shape the pulse and vary the pulse transmission time so that the segmented local coils are pulsed at a time that will cause the ion or charged particle beam to be accelerated. Therefore another difference in the embodiment illustrated in FIG. 3 is that instead of making the local coils 18 electronically independent and controlled by timer 24 and powered by power supply 28 as in FIG. 1, the segments are connected in series and powered by a pulse running along the transmission lines 43 with the transmission lines 43 and capacitors 38 acting as timers. The transmission lines 43 would be attached to a switch or timer similar to timer 24 in FIG. 1, and the mirrors would be attached to an electrical system similar to the system in FIG. 1.

The foregoing description of preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. An method of accelerating ions or charged particles, comprising the steps of:

generating a plasma of electrons and ions confined in a magnetic mirror field with a central axis;

heating the plasma electrons to high temperatures;

directing an ion or particle beam substantially along the central axis of the magnetic mirror field; and pulsing one or more local coils aligned substantially along the central axis of the magnetic mirror field, as the ions or charged particles pass the local coils wherein each local coil is pulsed rapidly so that the local coil increases the magnetic field substantially along the central axis of the magnetic mirror field near that local coil, thus generating a transient positive space charge which accelerates the ion or particle beam.

2. A method, as recited in claim 1, wherein the step for heating the plasma electrons, comprises the steps of:

generating microwaves; and directing the microwaves to the plasma.

3. A method, as recited in claim 1, wherein the step for pulsing one or more local coils, comprises the step of, sequentially pulsing more than one local coil.

4. A method, as recited in claim 1, further comprising the step of, focusing the ion or particle beam by providing magnetic fields from the local coils and the magnetic mirror field so as to produce focusing electrical equipotentials.

5. A method, as recited in claim 1, wherein the step for heating the plasma, further comprises the step of adiabatically compressing the pre-heated plasma by slowly increasing the magnetic mirror field.

6. An apparatus for accelerating ions or charged particles, comprising:

means for generating a plasma of electrons and ions, and heating the plasma electrons to high temperatures;

means for confining the plasma in a magnetic mirror field, with a central axis;

a beam source which directs an ion or particle beam substantially along the central axis of the magnetic mirror field;

one or more local coils aligned substantially along the central axis of the magnetic mirror field; and means for pulsing the local coils so that as the ions or charged particles from the beam source pass a local coil, the local coil is pulsed, which rapidly increases the magnetic field substantially along the axis of the magnetic mirror field near the local coil, thus generating a positive space charge which accelerates the ion or particle beam.

7. An apparatus, as recited in claim 6, wherein the means for generation a plasma and heating the plasma electrons, comprises;

means for generating microwaves; and means for directing the microwaves to the plasma.

8. An apparatus, as recited in claim 7, wherein the magnetic mirror fields and the local coils also produce focusing electrical equipotentials which provide a focusing of the ion or particle beam.

9. An apparatus, as recited in claim 8, wherein the apparatus has more than one local coil and wherein the means for pulsing the local coils further comprises a means for sequentially pulsing the local coils.

10. An apparatus, as recited in claim 8, wherein the means for heating the plasma, further comprises means for adiabatically compressing the pre-heated plasma by slowly increasing the magnetic mirror field.

11. An apparatus, as recited in claim 9, wherein the means for sequentially pulsing the plurality of local coils comprises at least one timer, wherein each local coil is attached to a timer.

12. An apparatus, as recited in claim 11, wherein each local coil of the plurality of local coils, comprises a single conductor in a winding and the local coils are electrically independent from each other.

13. An apparatus, as recited in claim 9, wherein each local coil comprises a plurality of segments.

14. An apparatus, as recited in claim 13, wherein the means for sequentially pulsing the plurality of local coils, comprise:

a plurality of transmission lines with each transmission line electrically connecting a segment in one local coil to a segment in a subsequent local coil; and capacitors with one end of the capacitor electrically connected to a transmission line and another end grounded.

15. An apparatus, as recited in claim 14, wherein the means for generating and confining a plasma in a magnetic mirror field has a mirror ratio near the range of 1.25–10.

16. An apparatus, as recited in claim 14, wherein each of the local coils produces magnetic field of the order of the magnetic mirror field when the local coil is pulsed.

* * * * *